US005865199A

United States Patent [19]

Pedziwiatr et al.

[11] Patent Number: 5,865,199

[45] Date of Patent: Feb. 2, 1999

[54] ULTRASONIC CLEANING APPARATUS

[76] Inventors: Michael P. Pedziwiatr, 165 Jersey Ave., Greenwood Lake, N.Y. 10925; Edward A. Pedziwiatr, 50 Glenview Ter., Cresskill, N.J. 07626

[21] Appl. No.: 961,817

[22] Filed: Oct. 31, 1997

[51] Int. Cl.[6] ..... B08B 3/12

[52] U.S. Cl. ..... 134/184; 134/1; 310/317; 310/322; 310/324

[58] Field of Search ..... 134/184, 186, 134/1, 1.3; 68/355; 366/114, 115, 127; 310/317, 322, 324, 334

[56] References Cited

U.S. PATENT DOCUMENTS 4,118,649 10/1978 Shwartzman et al. ..... 134/184 X
4,477,311 10/1984 Mimura et al. ..... 134/1 X
5,038,808 8/1991 Hammond et al. ..... 134/1 X
5,203,362 4/1993 Shibata ..... 134/184
5,247,954 9/1993 Grant et al. ..... 134/184

*Primary Examiner*—Philip R. Coe
*Attorney, Agent, or Firm*—Arthur Jacob

[57] ABSTRACT

An improvement in ultrasonic cleaning in which articles to be cleaned are immersed in a bath subjected to ultrasonic energy emanating from ultrasonic transducers coupled to a vibratory diaphragm contiguous with the bath, the ultrasonic transducers being in multiple sets for providing ultrasonic energy at multiple ultrasonic frequencies at interspersed locations spaced apart a distance enabling the multiple sets of transducers simultaneously to transmit to the bath ultrasonic energy at the multiple ultrasonic frequencies without deleterious interference arising out of the simultaneous presence of the multiple ultrasonic frequencies.

26 Claims, 6 Drawing Sheets

ULTRASONIC CLEANING APPARATUS

The present invention relates generally to ultrasonic cleaning apparatus and method and pertains, more specifically, to ultrasonic cleaning apparatus and method in which ultrasonic cleaning of articles is carried out in a bath to which ultrasonic energy of different frequencies is provided simultaneously for accomplishing cleaning of the articles.

Ultrasonic cleaning systems have found widespread use in the cleaning of manufactured parts. In particular, various industrial contaminants, such as drawing oils, coolants, and particulates have been removed successfully from manufactured parts by immersing the parts in a bath to which ultrasonic energy is provided for accomplishing cleaning of the parts. Current ultrasonic cleaning systems employ piezoelectric ultrasonic transducers mounted to the bottom of a tank containing a fluid bath within which the articles to be cleaned are immersed. The transducers are powered and the bottom of the tank serves as a vibratory diaphragm through which ultrasonic energy emanating from the transducers is transmitted to the bath for accomplishing cleaning of the articles.

The ultrasonic transducers employed in ultrasonic cleaning systems are made available in various ultrasonic frequencies, with each frequency providing specific cleaning characteristics and properties. Generally, lower frequencies are more efficient in removing larger particles from articles being cleaned, while higher frequencies are more effective for removing submicronic particulates. Users of ultrasonic cleaning equipment usually determine which frequency is best suited to the needs of a particular cleaning operation and choose the systems most appropriate to those needs. However, in some instances, the range of sizes of particles to be removed is quite wide and an ultrasonic cleaning system operating at a single ultrasonic frequency is not as effective as desired. In other instances, contaminants are adhered to the articles to be cleaned with such tenacity that there is a need for the added power available in low-frequency ultrasonic energy to dislodge such contaminants, while the characteristics of high-frequency ultrasonic energy are needed to deal with submicronic contaminants which also are present.

Traditionally, ultrasonic cleaning machines have been constructed with ultrasonic transducers of one selected frequency coupled to one cleaning tank. Any requirement for accomplishing ultrasonic cleaning at different frequencies has been attained by utilizing separate cleaning tanks powered by separate ultrasonic transducers of different frequencies. It had been thought that ultrasonic transducers of different ultrasonic frequencies, mounted side-by-side upon the same tank, and thus coupled to a common vibratory diaphragm, would interfere with one another with the result that, at the very least, cleaning effectiveness would be very much diminished or, at worst, the transducers would be destroyed. Accordingly, ultrasonic cleaning machines have been limited to mounting only transducers of a single frequency on a particular cleaning tank.

Another deterrent to mounting ultrasonic transducers of different frequencies upon a common vibratory diaphragm is the observed phenomenon of cavitational erosion. It has been found that the bottom wall of a tank upon which there are mounted ultrasonic transducers will erode in time at the location where each transducer is coupled to the bottom wall. Erosion is particularly evident where lower ultrasonic frequencies, such as 40 kHz and lower, and concomitant higher power, are utilized. In order to compensate for such erosion, material having a greater wall thickness is utilized for tanks employed for low-frequency ultrasonic cleaning. However, higher frequency ultrasonic transducers, in the range of 80 kHz, require the use of relatively thin diaphragms since such transducers have a significantly shorter stroke, operate under less power, and would not be capable of effective operation if coupled to the relatively thick wall of a cleaning tank utilized in connection with low-frequency ultrasonic cleaning. Conversely, the use of low-frequency, higher power ultrasonic transducers coupled to a tank having the thinner walls appropriate for high-frequency ultrasonic cleaning would lead to accelerated failure of the tank due to the deleterious effects of cavitational erosion.

The present invention provides ultrasonic cleaning apparatus and method which utilizes ultrasonic energy of different frequencies for attaining the benefits provided by the different frequencies, while avoiding the deleterious effects outlined above. As such, the present invention attains several objects and advantages, some of which are summarized as follows: Enables ultrasonic cleaning of articles through the simultaneous utilization of both low and high frequency ultrasonic energy for more effective ultrasonic cleaning; provides simplified ultrasonic cleaning apparatus in that a single cleaning tank is employed for cleaning with multiple frequency ultrasonic energy utilized simultaneously for efficient ultrasonic cleaning of articles; attains more effective ultrasonic cleaning in less time and with less energy than heretofore accomplished with conventional ultrasonic cleaning apparatus and methods; provides a more uniform ultrasonic energy field throughout an ultrasonic cleaning bath for more efficient cleaning of articles placed in the bath; reduces the time required for completing ultrasonic cleaning operations; increases the reliability and the service life of ultrasonic cleaning apparatus.

The above objects and advantages, as well as further objects and advantages, are attained by the present invention which may be described briefly as an improvement in ultrasonic cleaning apparatus in which articles to be cleaned are immersed in a bath subjected to ultrasonic energy emanating from ultrasonic transducers coupled to a wall contiguous with the bath, the improvement comprising: first transducers for providing ultrasonic energy at a first ultrasonic frequency; and second transducers for providing ultrasonic energy at a second ultrasonic frequency different from the first ultrasonic frequency; the first transducers being interspersed with the second transducers, with the first transducers being placed at first locations along the wall and the second transducers being placed at second locations along the wall, each first location being spaced from an adjacent second location a distance enabling the first and second transducers simultaneously to transmit to the bath ultrasonic energy at the respective first and second ultrasonic frequencies to accomplish effective cleaning of the articles immersed in the bath.

The invention further includes an improvement in an ultrasonic cleaning method in which articles to be cleaned are immersed in a bath subjected to ultrasonic energy emanating from locations along a wall contiguous with the bath, the improvement comprising: providing ultrasonic energy at first locations along the wall at a first ultrasonic frequency; and providing ultrasonic energy at second locations along the wall at a second ultrasonic frequency different from the first ultrasonic frequency; the first locations being interspersed with the second locations, with each first location being spaced from an adjacent second location a distance enabling simultaneous transmission to the bath of ultrasonic energy at the respective first and second ultrasonic frequencies to accomplish effective cleaning of the articles immersed in the bath.

The invention will be understood more fully, while still further objects and advantages will become apparent, in the following detailed description of preferred embodiments of the invention illustrated in the accompanying drawing, in which.

Figure 1:
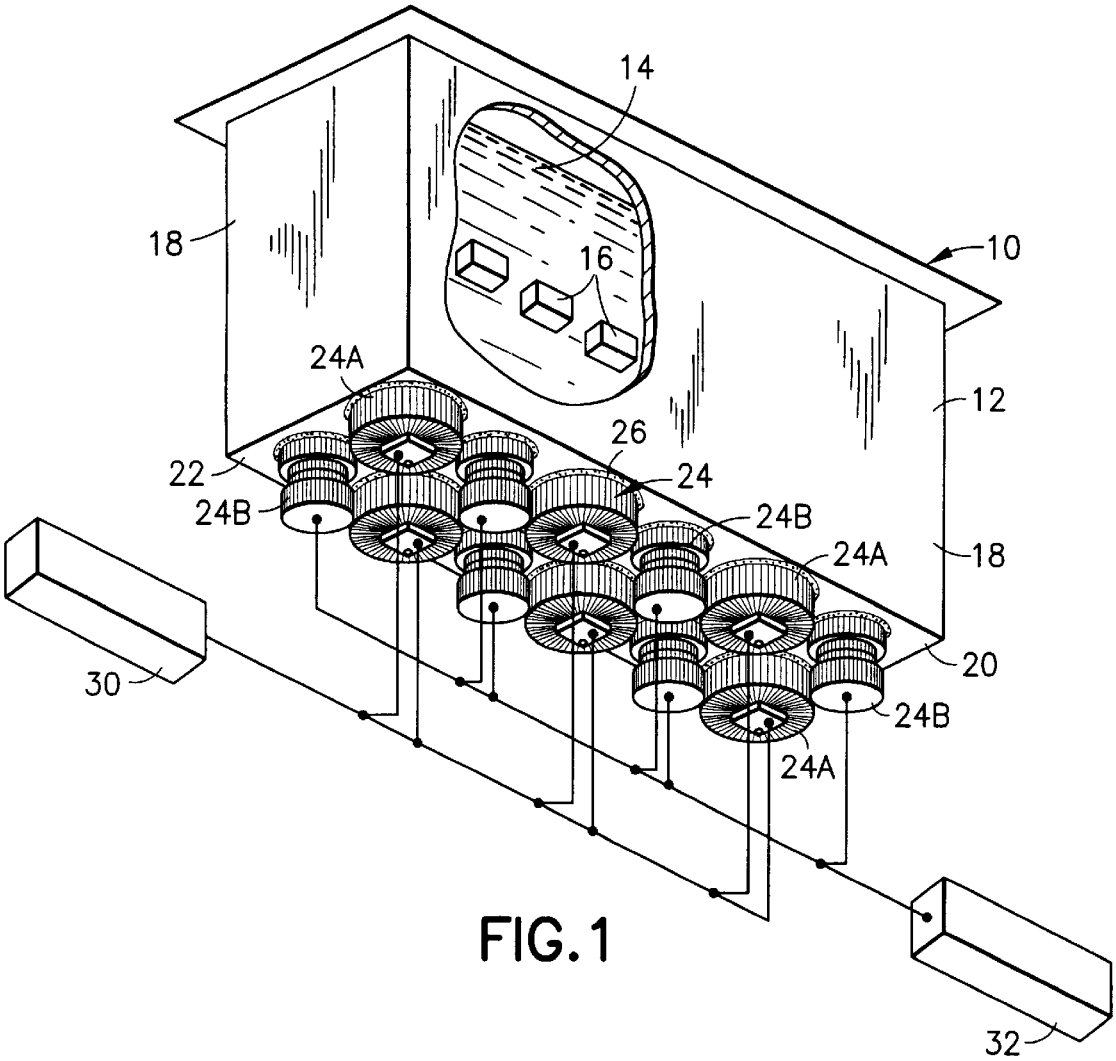
FIG. 1 is a partially diagrammatic, pictorial bottom perspective illustration of an ultrasonic cleaning apparatus constructed in accordance with the present invention, with portions broken away to show internal details.
Figure 2:
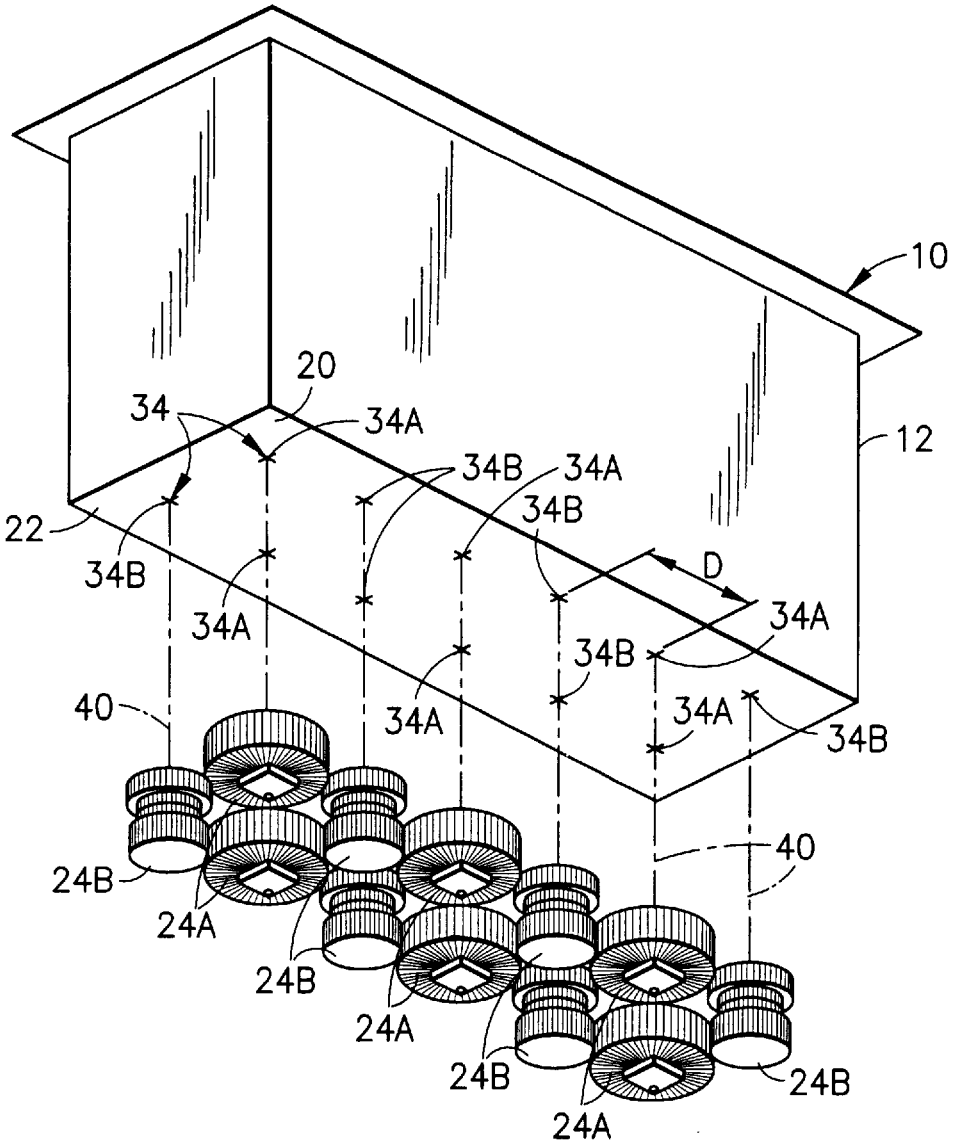
FIG. 2 is a pictorial perspective view similar to FIG. 1, but with component parts exploded relative to one another for illustrative purposes.

Referring now to the drawing, and especially to FIGS. 1 and 2 thereof, an ultrasonic cleaning apparatus constructed in accordance with the present invention is shown at 10 and is seen to include a cleaning tank 12 containing a cleaning bath 14 of ultrasonic cleaning fluid within which there are immersed articles 16 to be cleaned ultrasonically. Tank 12 preferably is constructed of a corrosion-resistant metal, such as stainless steel, and includes side walls 18 and a bottom wall 20. Bottom wall 20 has an outer surface 22, and a plurality of ultrasonic transducers 24 are affixed to the outer surface 22, as by an adhesive layer 26 placed between the outer surface 22 and each transducer 24. In this manner, transducers 24 are coupled to the bottom wall 20, and bottom wall 20 serves as a vibratory diaphragm which transmits ultrasonic energy emanating from the transducers 24 to the bath 14 for effecting cleaning of the articles 16.

Transducers 24 are divided into two sets of transducers: namely; first transducers 24A which comprise a first set of transducers, and second transducers 24B which comprise a second set of transducers. Transducers 24A are powered by a first power supply 30 to provide ultrasonic energy at a first ultrasonic frequency, and transducers 24B are powered by a second power supply 32 to provide ultrasonic energy at a second ultrasonic frequency different from the first ultrasonic frequency. Each transducer 24 is placed at a location 34 along the outer surface 22 of the bottom wall 20, with each transducer 24A placed at a respective first location 34A along the outer surface 22 of the bottom wall 20 and each transducer 24B placed at a respective second location 34B along the outer surface 22 of the bottom wall 20, such that the first set of transducers 24A are interspersed with the second set of transducers 24B.

Each first location 34A is spaced from an adjacent second location 34B a distance D which is selected so as to enable both sets of transducers 24A and 24B to operate simultaneously to transmit to the bath 14 ultrasonic energy at the respective first and second ultrasonic frequencies. Thus, it has been found that if the spacing between adjacent locations 34A and 34B is too small, the simultaneous operation of transducers 24A and 24B will interfere with one another, causing ineffective cleaning, and even malfunction of the transducers 24. Too large a spacing between locations 34A and 34B leads to an uneven field of ultrasonic energy in the bath 14, and consequent ineffective cleaning. In the preferred arrangement, the first ultrasonic frequency is about twice the second ultrasonic frequency, and the distance D is great enough to allow simultaneous operation of both sets of transducers 24A and 24B without deleterious interference between the sets. For example, superior ultrasonic cleaning results have been attained where the first ultrasonic frequency is about 80 kHz, the second ultrasonic frequency is about 40 kHz, and the distance D is about 3.25 inches. It has been observed that the aforesaid ultrasonic frequencies and distance D between adjacent locations 34A and 34B not only provides the desirable cleaning characteristics of both high-frequency and low-frequency ultrasonic energy simultaneously, but also yields a more uniform field of ultrasonic energy within the bath 14, with ultrasonic energy of one ultrasonic frequency filling in between ultrasonic energy of the other ultrasonic frequency, without deleterious interference between the different ultrasonic frequencies. In this connection, bottom wall 20 preferably is generally flat and extends essentially along a plane, and ultrasonic energy from transducers 24 is transmitted into the bath 14 along essentially parallel directions 40, normal to the plane along which bottom wall 20 extends, with the directions of the high-frequency and low-frequency ultrasonic energy interspersed within the field of ultrasonic energy established in the bath 14. Other combinations of higher and lower ultrasonic frequencies may be employed, the range of such frequencies being between about 20 kHz and 160 kHz.

Figure 3:
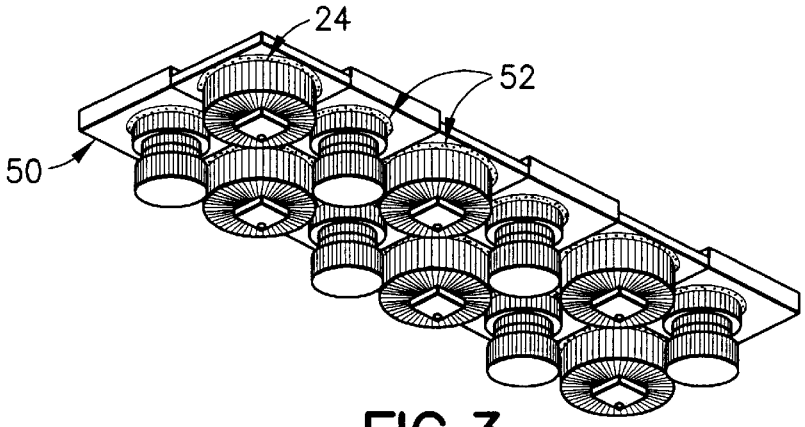
FIG. 3 is a pictorial perspective view of a portion of an alternate embodiment of the present invention.
Figure 4:
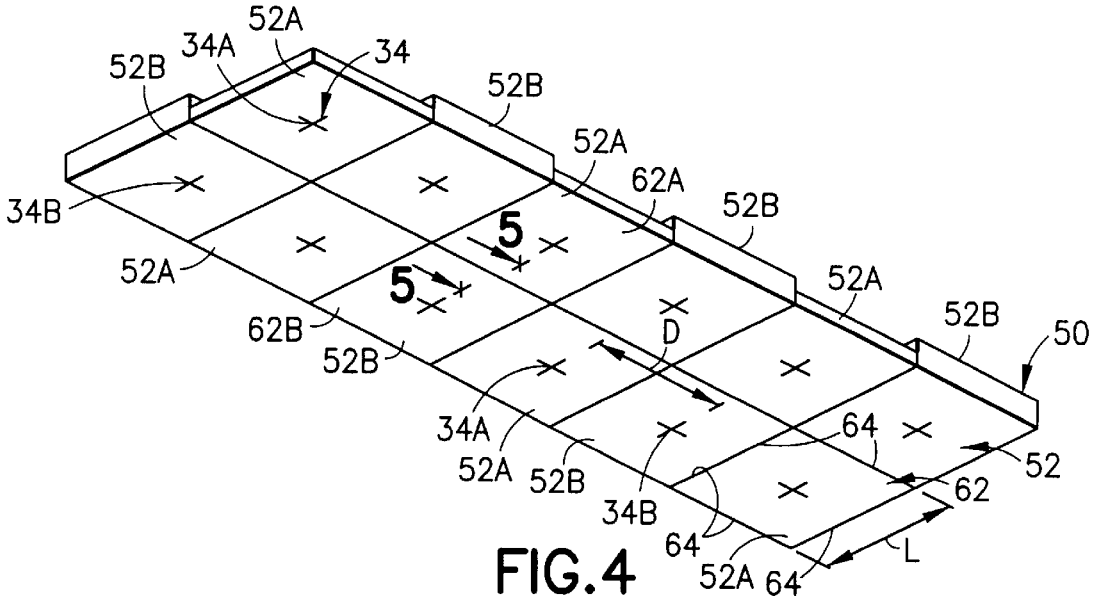
FIG. 4 is an enlarged perspective view of a component part of the portion illustrated in FIG. 3.
Figure 5:
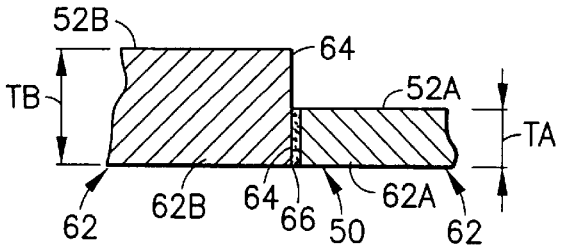
FIG. 5 is a further enlarged, fragmentary cross-sectional view taken along line 5—5 of FIG. 4.

Turning now to the embodiment of the invention illustrated in FIGS. 3 through 5, in order to further enhance the transmission of ultrasonic energy from the transducers 24 to the bath 14 within the tank 12 (as illustrated in FIGS. 1 and 2), an alternate bottom wall 50 provides the vibratory diaphragm to which the transducers 24 are coupled. The alternate bottom wall 50 is divided into individual domains 52 associated with each location 34, with domains 52A placed at locations 34A and domains 52B placed at locations 34B. As seen in FIG. 5, the wall thickness TA of domains 52A is different from, and less than the wall thickness TB of domains 52B, so that the transmission of ultrasonic energy at the higher ultrasonic frequency provided by transducers 24A is optimized by the thinner wall thickness of domains 52A, while the transmission of ultrasonic energy at the lower ultrasonic frequency provided by transducers 24B is permitted through the thicker wall thickness of domains 52B, with the thicker wall thickness compensating for cavitational erosion and enabling a longer service life.

In the preferred construction of bottom wall 50, each domain 52 is constructed of a plate 62 having a generally flat, essentially planar, rectangular configuration with edges 64 extending along the boundaries of the rectangular configuration of each domain 50. The preferred material for plates 62 is stainless steel. Plates 62A, which establish domains 52A, are thinner than plates 62B, which establish domains 52B and the plates 62 are joined together at contiguous edges 64, as by welding as shown at 66, to form an integral bottom wall 50 extending essentially along a plane and having thinner domains 52A at locations 34A and thicker domains 52B at locations 34B. For example, where the first ultrasonic frequency is about 80 kHz and the second ultrasonic frequency is about 40 kHz, the preferred thickness of each plate 62A is about 18 gauge, or 0.0480 inch, while the preferred thickness of each plate 62B is about 12 gauge, or 0.1054 inch. Preferably, the generally rectangular configuration of each plate 62 is a square in which each edge 64 has a length L of about 3.25 inches, thereby providing a distance D between adjacent locations 34A and 34B of about 3.25 inches.

Figure 6:
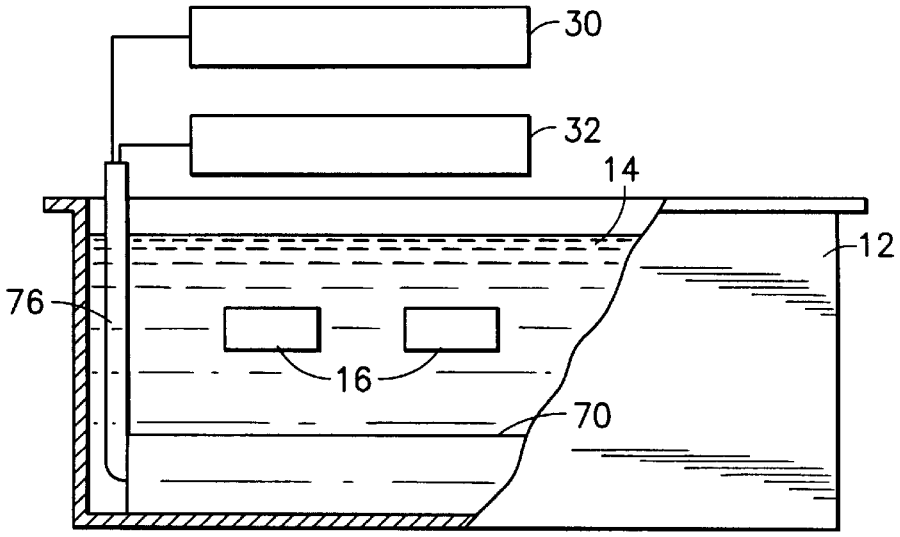
FIG. 6 is a diagrammatic cross-sectional view showing another embodiment of the invention.
Figure 7:
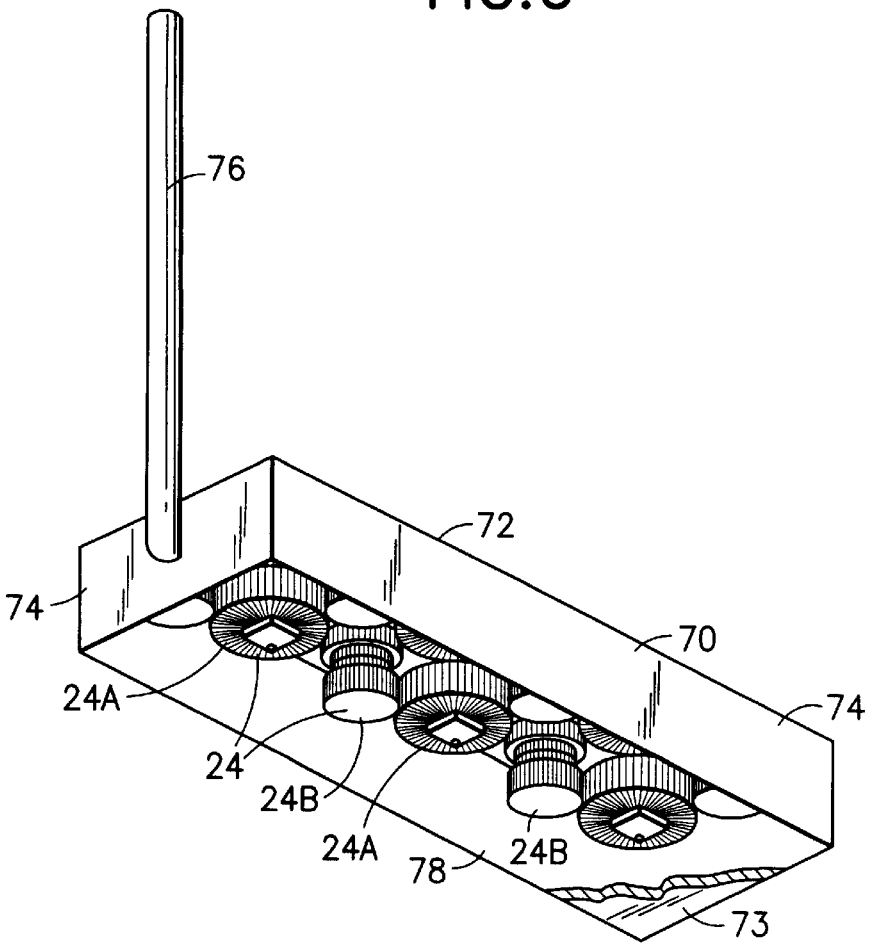
FIG. 7 is a perspective view, partially cut away, of a component of the embodiment of FIG. 6.
Figure 8:
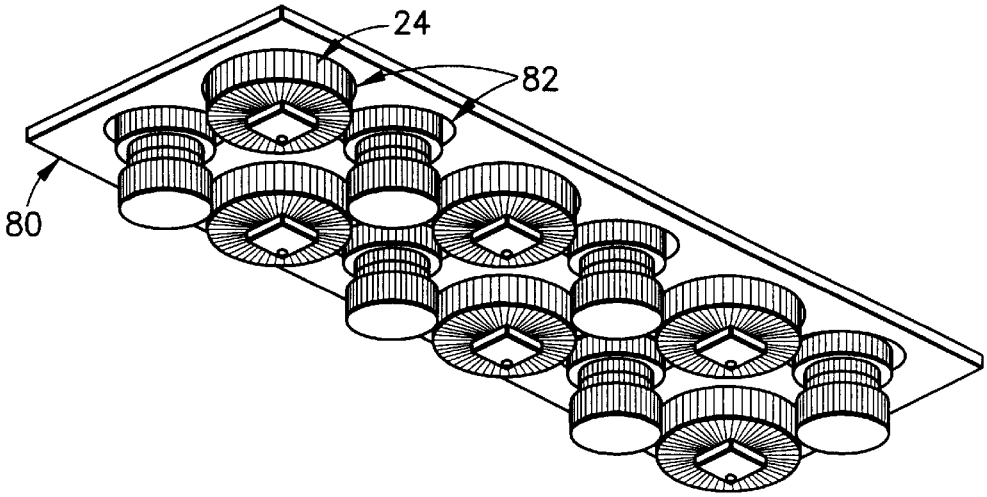
FIG. 8 is a pictorial perspective view of a portion of another alternate embodiment of the present invention.
Figure 9:
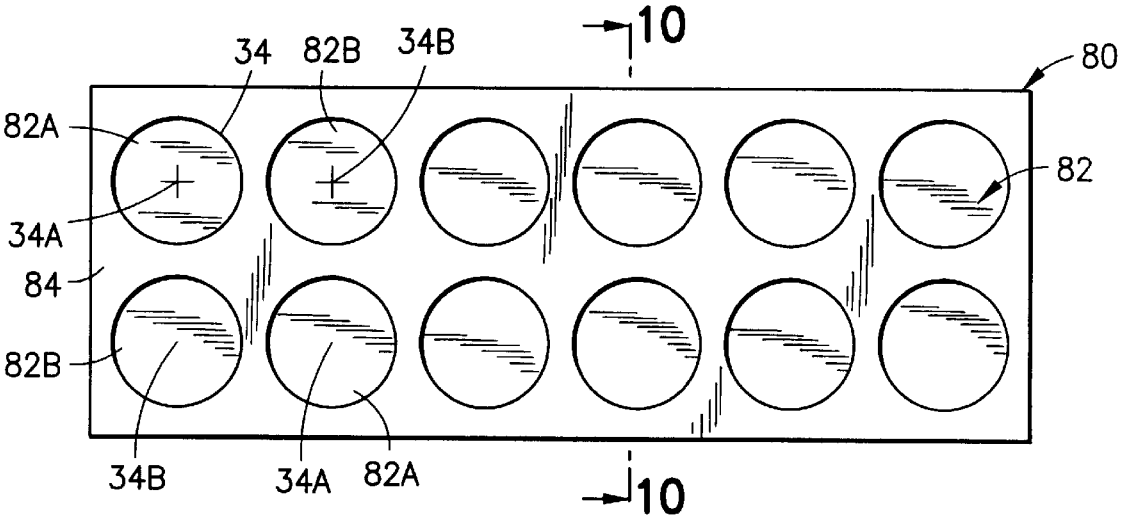
FIG. 9 is a plan view of a component part of the portion illustrated in FIG. 8.

In the apparatus of FIGS. 6 and 7, the transducers 24 are housed in a separate housing 70 which is immersed in the bath 14 within tank 12 and is sealed against the entry of the ultrasonic cleaning fluid of the bath 14. The housing includes a top wall 72 which serves as a vibratory diaphragm to which the transducers 24 are coupled for the transmission of ultrasonic energy into the bath 14 to accomplish ultrasonic cleaning of the articles 16 immersed in the bath 14. A bottom wall 73 and side walls 74 seal the housing 70. As in the earlier-described embodiments, the transducers 24 are provided in two sets, with first transducers 24A powered by a first power supply 30 to provide ultrasonic energy at a first ultrasonic frequency, and transducers 24B powered by a second power supply 32 to provide ultrasonic energy at a second ultrasonic frequency different from the first ultrasonic frequency. Each power supply 30 and 32 is connected to respective transducers 24 through a conduit 76 extending outside the bath 14 and communicating with the interior 78 of the housing 70.

Figure 10:
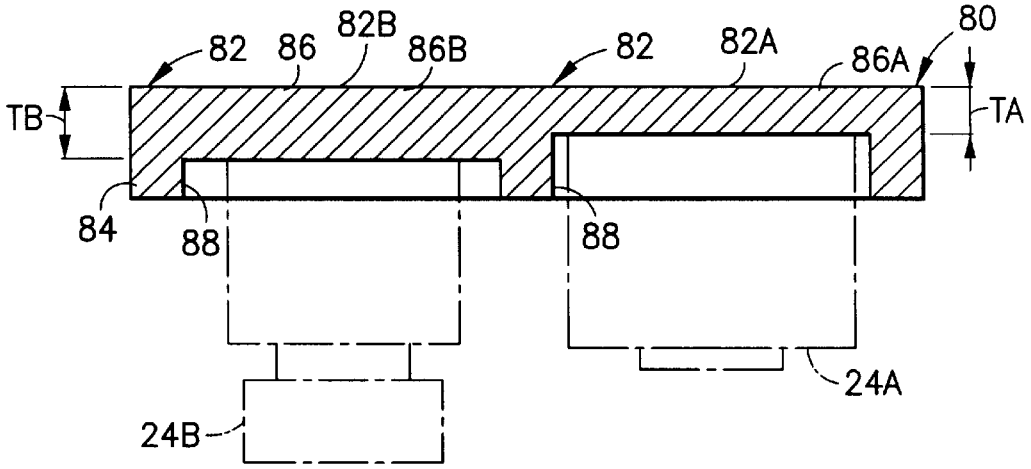
FIG. 10 is an enlarged cross-sectional view taken along line 10—10 of FIG. 9.

Turning now to the embodiments illustrated in FIGS. 8 through 11, an alternate bottom wall 80 for tank 12 includes a domain 82 associated with each location 34 for a transducer 24. Bottom wall 80 includes a web 84, with domains 82A placed at locations 34A and domains 82B placed at locations 34B. As seen in FIG. 10, each domain 82 includes a section 86 having a prescribed wall thickness, the wall thickness TA of section 86A of domain 82A being different from, and less than, the wall thickness TB of section 86B of domain 82B. Each domain 82 includes a recess 88 associated with the section 86 of the domain 82. Hence, the domains 82A and 82B are constructed with sections 86A and 86B of different wall thicknesses by merely machining away portions of a sheet of material to establish bottom wall 80 with recesses 88 having different depths to form sections 86A and 86B of different wall thicknesses, with the bottom wall 80 extending essentially along a plane. Preferably, the recesses 88 are cylindrical and the resulting sections 86 are circular. The transducers 24A and 24B then are mounted upon respective sections 86A and 86B, as illustrated in phantom, to optimize the transmission of the higher and lower frequency ultrasonic energy, by virtue of each section 86 providing a vibratory diaphragm best suited to the transducer 24 mounted on the section 86.

Figure 11:
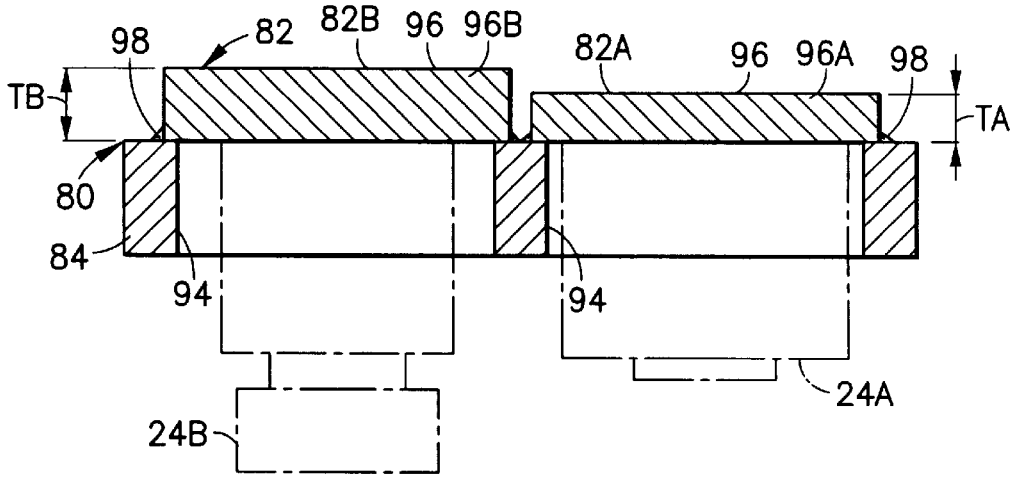
FIG. 11 is an enlarged cross-sectional view similar to FIG. 10, but showing an alternate construction.

In the alternate construction illustrated in FIG. 11, the domains 82 each include an aperture 94 extending through the bottom wall 80, and a plate 96 extending over the aperture 94 and joined to the bottom wall 80 as by welding, as shown at 98, to establish an integral bottom wall 80 extending essentially along a plane. The domains 82A and 82B are constructed with plates 96A and 96B of different wall thicknesses, the wall thickness TA of plate 96A of domain 82A being less than the wall thickness TB of plate 96B of domain 82B. Preferably, the apertures 94 are cylindrical and the plates 96 are circular, with a weld 98 following the circular periphery of each plate 96. The transducers 24A and 24B then are mounted upon respective plates 96A and 96B, as illustrated in phantom, to optimize the transmission of the higher and lower frequency ultrasonic energy, by virtue of each plate 96 providing a vibratory diaphragm best suited to the transducer 24 mounted on the plate 96.

The simultaneous transmission of ultrasonic energy of multiple ultrasonic frequencies into a single ultrasonic cleaning bath, as described above, increases the range of contaminants and particulate size which can be cleaned effectively from a wider variety of articles by ultrasonic cleaning techniques. In addition, the combination of high-frequency ultrasonic energy and low-frequency ultrasonic energy provided simultaneously in the same bath enables a more evenly distributed cavitational energy, with the higher frequency ultrasonic energy filling the voids between standing waves created by the lower frequency ultrasonic energy, for enhanced cleaning characteristics, both from the standpoint of the range of contaminants and particulate sizes and the increased speed with which total cleaning is accomplished.

It will be seen that the present invention attains the several objects and advantages summarized above, namely: Enables ultrasonic cleaning of articles through the simultaneous utilization of both low and high frequency ultrasonic energy for more effective ultrasonic cleaning; provides simplified ultrasonic cleaning apparatus in that a single cleaning tank is employed for cleaning with multiple frequency ultrasonic energy utilized simultaneously for efficient ultrasonic cleaning of articles; attains more effective ultrasonic cleaning in less time and with less energy than heretofore accomplished with conventional ultrasonic cleaning apparatus and methods; provides a more uniform ultrasonic energy field throughout an ultrasonic cleaning bath for more efficient cleaning of articles placed in the bath; reduces the time required for completing ultrasonic cleaning operations; increases the reliability and the service life of ultrasonic cleaning apparatus.

It is to be understood that the above detailed description of preferred embodiments of the invention is provided by way of example only. Various details of design, construction and procedure may be modified without departing from the true spirit and scope of the invention, as set forth in the appended claims.

The embodiments of the invention in which an exclusive property or privilege is claimed are defined as follows:

1. An improvement in ultrasonic cleaning apparatus in which articles to be cleaned are immersed in a bath subjected to ultrasonic energy emanating from ultrasonic transducers coupled to a wall contiguous with the bath, the improvement comprising:

first transducers for providing ultrasonic energy at a first ultrasonic frequency; and second transducers for providing ultrasonic energy at a second ultrasonic frequency different from the first ultrasonic frequency;

the first transducers set being interspersed with the second transducers, with the first transducers being placed at first locations along the wall and the second transducers being placed at second locations along the wall, each first location being spaced from an adjacent second location a distance enabling the first and second transducers simultaneously to transmit to the bath ultrasonic energy at the respective first and second ultrasonic frequencies to accomplish effective cleaning of the articles immersed in the bath.

2. The invention of claim 1 wherein the first ultrasonic frequency is greater than the second ultrasonic frequency.

3. The invention of claim 1 wherein the first ultrasonic frequency is about 80 kHz and the second ultrasonic frequency is about 40 kHz.

4. The invention of claim 1 wherein the spacing between adjacent first and second locations is about 3.25 inches.

5. The invention of claim 1 wherein the wall is essentially planar and the ultrasonic energy is transmitted into the bath along essentially parallel, interspersed directions.

6. The invention of claim 1 wherein the wall includes a first thickness at each first location and a second thickness at each second location, the first thickness being different from the second thickness.

7. The invention of claim 1 wherein the first ultrasonic frequency is greater than the second ultrasonic frequency, the wall includes a first thickness at each first location and a second thickness at each second location, and the first thickness is less than the second thickness.

8. The invention of claim 7 wherein the first ultrasonic frequency is about twice the second ultrasonic frequency.

9. The invention of claim 7 wherein the first ultrasonic frequency is about 80 kHz, the second ultrasonic frequency is about 40 kHz, the first thickness is about 0.0840 inch and the second thickness is about 0.1054 inch.

10. The invention of claim 9 wherein the spacing between adjacent first and second locations is about 3.25 inches.

11. The invention of claim 9 wherein the wall is essentially planar and the ultrasonic energy is transmitted into the bath along essentially parallel, interspersed directions.

12. The invention of claim 1 wherein the wall includes first domains at the first locations and second domains at the second locations, the first domains having a first thickness and the second domains having a second thickness different from the first thickness.

13. The invention of claim 12 wherein the first domains comprise first plates having first edges, the second domains comprise second plates having second edges, and the first and second plates are joined together along contiguous first and second edges into an integral wall.

14. The invention of claim 13 wherein the first and second plates each have a rectangular configuration within corresponding edges of the respective plates, with the first rectangular plates being contiguous with the second rectangular plates in the integral wall.

15. The invention of claim 14 wherein the rectangular configuration is a square having sides of about 3.25 inches extending along the corresponding edges.

16. The invention of claim 14 wherein the wall is essentially planar and the ultrasonic energy is transmitted into the bath along essentially parallel, interspersed directions.

17. The invention of claim 14 wherein the first ultrasonic frequency is greater than the second ultrasonic frequency and the first thickness is less than the second thickness.

18. The invention of claim 14 wherein the first ultrasonic frequency is about 80 kHz, the second ultrasonic frequency is about 40 kHz, the first thickness is about 0.0480 inch and the second thickness is about 0.1054 inch.

19. The invention of claim 18 wherein the rectangular configuration is a square having sides of about 3.25 inches extending along the corresponding edges.

20. The invention of claim 1 wherein the wall includes first domains at the first locations and second domains at the second locations, the first domains comprising first sections in the wall, the first sections having a first thickness, and the second domains comprising second sections in the wall, the second sections having a second thickness different from the first thickness.

21. The invention of claim 20 wherein the wall has a wall thickness greater than either one of the first thickness and the second thickness, and recesses in the wall, each recess being contiguous with one of the first and second sections.

22. The invention of claim 20 wherein the first ultrasonic frequency is greater than the second ultrasonic frequency and the first thickness is less than the second thickness.

23. The invention of claim 20 wherein the first ultrasonic frequency is about 80 kHz, the second ultrasonic frequency is about 40 kHz, the first thickness is about 0.0480 inch and the second thickness is about 0.1054 inch.

24. The invention of claim 1 wherein the wall includes first domains at the first locations and second domains at the second locations, each first domain comprising a first aperture in the wall, and a first plate extending over the first aperture, the first plate having a first thickness and being joined to the wall, and each second domain comprising a second aperture in the wall, and a second plate extending over the second aperture, the second plate having a second thickness different from the first thickness and being joined to the wall.

25. The invention of claim 24 wherein the first ultrasonic frequency is greater than the second ultrasonic frequency and the first thickness is less than the second thickness.

26. The invention of claim 24 wherein the first ultrasonic frequency is about 80 kHz, the second ultrasonic frequency is about 40 kHz, the first thickness is about 0.0480 inch and the second thickness is about 0.1054 inch.

* * * * *

UNITED STATES PATENT AND TRADEMARK OFFICE

CERTIFICATE OF CORRECTION

PATENT NO. : 5,865,199

DATED : February 2, 1999

INVENTOR(S) : Michael P. Pedziwiatr et al

It is certified that error appears in the above-indentified patent and that said Letters Patent is hereby corrected as shown below:

Column 6, line 53, delete "set".

Column 7, line 19, "0.0840" should read --0.0480--.

Signed and Sealed this

Twenty-fifth Day of January, 2000

*Attest:*

*Attesting Officer*

*Acting Commissioner of Patents and Trademarks*